US005762340A

United States Patent [19]

Feola

[11] Patent Number: 5,762,340

[45] Date of Patent: Jun. 9, 1998

[54] METHOD OF PLAYING A POKER GAME

[76] Inventor: John Feola, 42 Irving St., Medford, Mass. 02155

[21] Appl. No.: 425,425

[22] Filed: Apr. 20, 1995

[51] Int. Cl.[6] ..... A63F 1/00

[52] U.S. Cl. ..... 273/292; 273/274; 273/309

[58] Field of Search ..... 273/292, 309, 273/274, 854; 463/13

[56] References Cited

U.S. PATENT DOCUMENTS

| | | | |
|---|---|---|---|
| 3,927,886 | 12/1975 | Day | 273/273 |
| 4,836,553 | 6/1989 | Suttle et al. | 273/292 |
| 4,948,134 | 8/1990 | Suttle et al. | 273/85 CP |
| 5,022,653 | 6/1991 | Suttle et al. | 463/13 |
| 5,248,142 | 9/1993 | Breeding | 273/138.1 |
| 5,265,882 | 11/1993 | Malek | 273/292 |
| 5,322,295 | 6/1994 | Cabot et al. | 273/292 |

OTHER PUBLICATIONS

Pai Gow Poker, Win Magazine, Apr. 1992, pp. 39, 40 and 70.

Scarne's Encyclopedia of Games by John Scarne, Harper & Row Publishers, 1973, pp. 33–38 and 40.

Scarne's Encyclopedia of Games by John Scarne, Harper & Row Publishers, 1973, pp. 6–12 and 38–42.

*Primary Examiner*—Benjamin H. Layno

*Attorney, Agent, or Firm*—Galgano & Burke

[57] ABSTRACT

The present invention provides various methods of playing a card game wherein the amount of successive wagers is pre-established. Each hand is preceded by players making at least one initial wager. A dealer then provides himself/herself with a plurality of cards and each player with at least one card to form an initial partial hand. The players are given the opportunity to view their initial partial hands and are then required to increase their wagers by a predetermined amount in order to continue playing that hand. If the player increases his/her wager by the predetermined amount, then the player will receive at least one additional card. Various embodiments of the present invention require subsequent wagers in different amounts. For example, one embodiment requires a player to place two subsequent wagers in amounts equal to the player's initial wager in order to complete the hand. Alternative embodiments require players to make more than three subsequent wagers in equal amounts in order to complete the hand. Still other embodiments require players to make wagers in successively increasing amounts.

23 Claims, 9 Drawing Sheets

FIG. 5

| 5 CARD STUD | | | |
|---|---|---|---|
| PROGRESSIVE STUD CHART WAGERS START FROM LEFT TO RIGHT | | | |
| 1st & 2nd Card | 3rd & 4th Card | 5 th Card | Total Dollars Wagered for All (7) Cards |
| $1 | $2 | $3 | 6 |
| 2 | 4 | 6 | 12 |
| 3 | 6 | 9 | 18 |
| 4 | 8 | 12 | 24 |
| 5 | 10 | 15 | 30 |
| 6 | 12 | 18 | 36 |
| 7 | 14 | 21 | 42 |
| 8 | 16 | 24 | 48 |
| 9 | 18 | 27 | 54 |
| 10 | 20 | 30 | 60 |

FIG. 6

| 7 CARD STUD | | | |
|---|---|---|---|
| PROGRESSIVE STUD CHART WAGES START FROM LEFT TO RIGHT | | | |
| 1st-2nd-3rd Card | 4th & 5th Card | 6th & 7th Card | Total Dollars Wagered for All (7) Cards |
| $1 | $2 | $3 | 6 |
| 2 | 4 | 6 | 12 |
| 3 | 6 | 9 | 18 |
| 4 | 8 | 12 | 24 |
| 5 | 10 | 15 | 30 |
| 6 | 12 | 18 | 36 |
| 7 | 14 | 21 | 42 |
| 8 | 16 | 24 | 48 |
| 9 | 18 | 27 | 54 |
| 10 | 20 | 30 | 60 |

METHOD OF PLAYING A POKER GAME

The present invention relates to card games and, more particularly, methods of playing card games wherein players must increase their initial wagers by predetermined amounts in order to remain in a given hand.

BACKGROUND OF THE INVENTION

People have enjoyed playing card games for many years. People particularly enjoy games which are interesting and exciting. When players are given the opportunity to wager on the outcome of a given hand, card games are usually considered more interesting. The level of interest will also typically increase as the amount wagered by the players increases.

One type of card game which is particularly popular is stud poker. In various forms of stud poker, a player receives cards from a dealer and the player forms the best hand from his/her combination of cards according to a predetermined poker hierarchy. "STUD" poker is distinguished from "DRAW" poker which permits players to exchange one or more cards from the initially dealt hand for replacement cards. In STUD poker, a player must play the cards that the player is initially dealt.

Conventional games of DRAW poker require each player to make an initial bet, i.e. an "ante", and then provide players with the option of increasing the amount wagered before receiving a complete hand. In a conventional STUD poker game, the amount that a player may increase the wager may have a maximum limit but is typically not predetermined.

People desiring to participate in card games at a casino or other gaming establishment can feel intimidated if they do not know the rules of the game. It would therefore be desirable to provide a novel card game which offers to excitement of multiple wagers and requires players to make a number of decisions for each hand, but relieves players of the responsibility of determining the amount of their wager.

Another aspect of conventional casino card games is the requirement that a plurality of players participate before the game commences. It would therefore be desirable to provide a poker-type game which permits play with a single player.

Since conventional games require all players in the game to play either five or seven-card versions of the game, it would also be desirable to provide players in the same game and playing the same hand, with the option of player hands which utilize different amounts of cards.

It would also be desirable to provide game layouts comprising indicia which indicate when an where wagers should be placed for inexperienced players.

It would also be desirable to provide a game which simplifies the player's decision as to the amount of wagers made following the initial wager(s).

SUMMARY OF THE INVENTION

The present invention provides various methods of playing a card game wherein the amount of successive wagers is pre-established. Each hand is preceded by players making at least one initial wager. A dealer then provides himself/herself with a plurality of cards and each player with at least one card to form an initial partial hand. The players are given the opportunity to view their initial partial hands and are then required to increase their wagers by a predetermined amount in order to continue playing that hand. If a player increases his/her wager by the predetermined amount, then the player will receive at least one additional card.

Various embodiments of the present invention require subsequent wagers in different amounts. For example, one embodiment requires a player to place two subsequent wagers in amounts equal to the player's initial wager in order to complete the hand. Alternative embodiments require players to make more than three subsequent wagers in equal amounts in order to complete the hand. Still further embodiments require players to make wagers in successively increasing amounts.

Embodiments of the present invention permit players to play a poker-type game without requiring a plurality of players.

Still further embodiments of the present invention provide players at a single table to play hands requiring different numbers of cards, even during the same hand.

Another advantageous aspect of the present invention is the provision of game boards which provide indicia for guiding players as to when wagers should be placed and how many cards a given wager will "buy" for a player.

According to another aspect of the present invention, a player is provided with an enhanced award under certain circumstances, such as if a player's hand matches the dealer's hand. The enhanced payout can either be a set amount or a progressive jackpot.

These and other embodiments are described below with reference to the drawings.

BRIEF DESCRIPTION OF THE DRAWINGS

FIGS. 5 and 6 illustrate wagering charts used with an alternative embodiment of the present invention.

DETAILED DESCRIPTION

The present invention is directed to novel card games which require at least one player to place a plurality of wagers in predetermined amounts, subsequent to placing an initial wager and before receiving cards necessary to complete the player's hand. According to the various embodiment of the present invention, if a player decides not to make a subsequent wager, the player automatically folds his/her hand and forfeits his/her opportunity to receive a winning payout for that hand and loses the ante. The players must therefore make decisions prior to receiving all of their cards.

Figure 1:
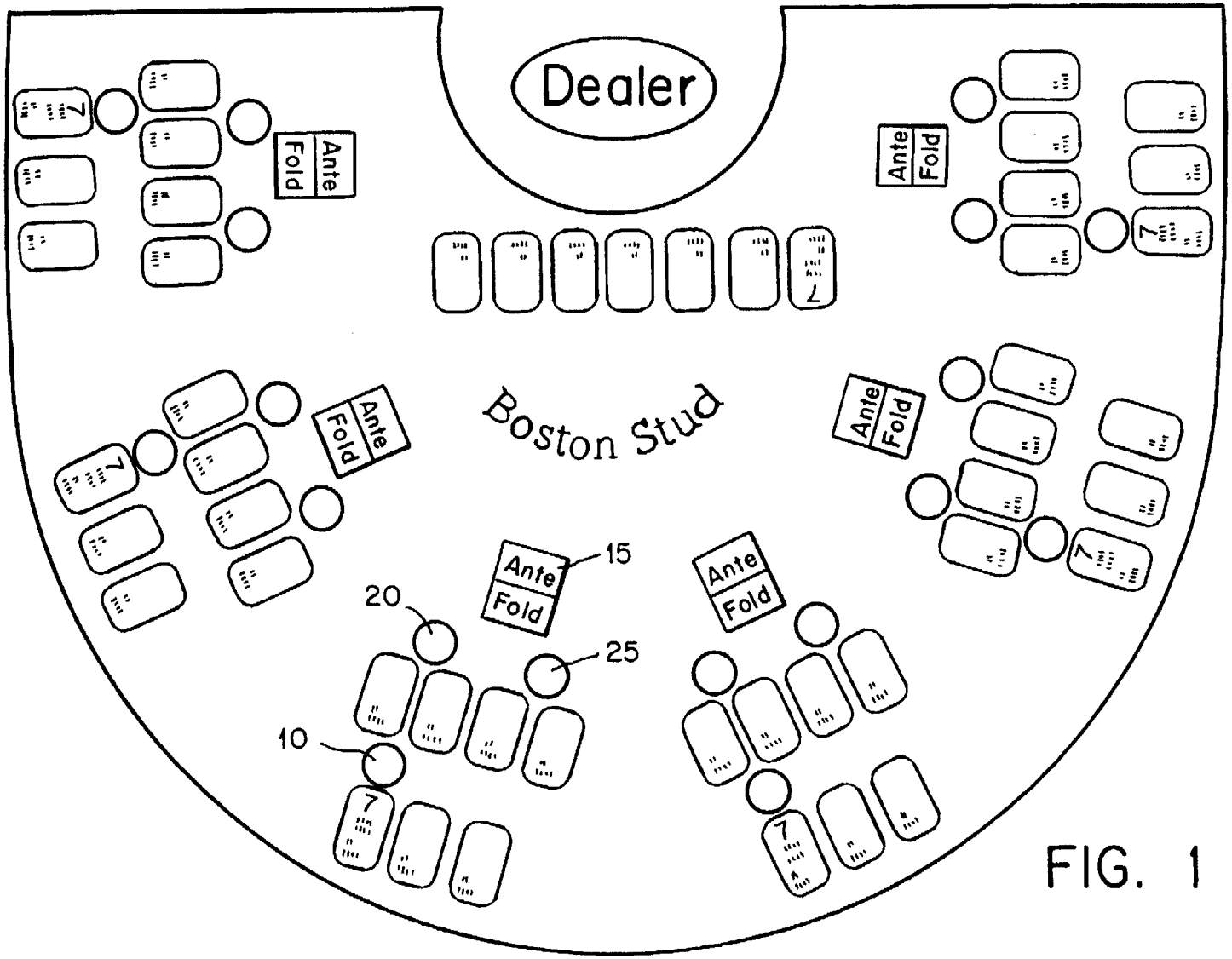
FIG. 1 illustrates a game board embodiment of one seven-card version of the present invention.
Figure 2:
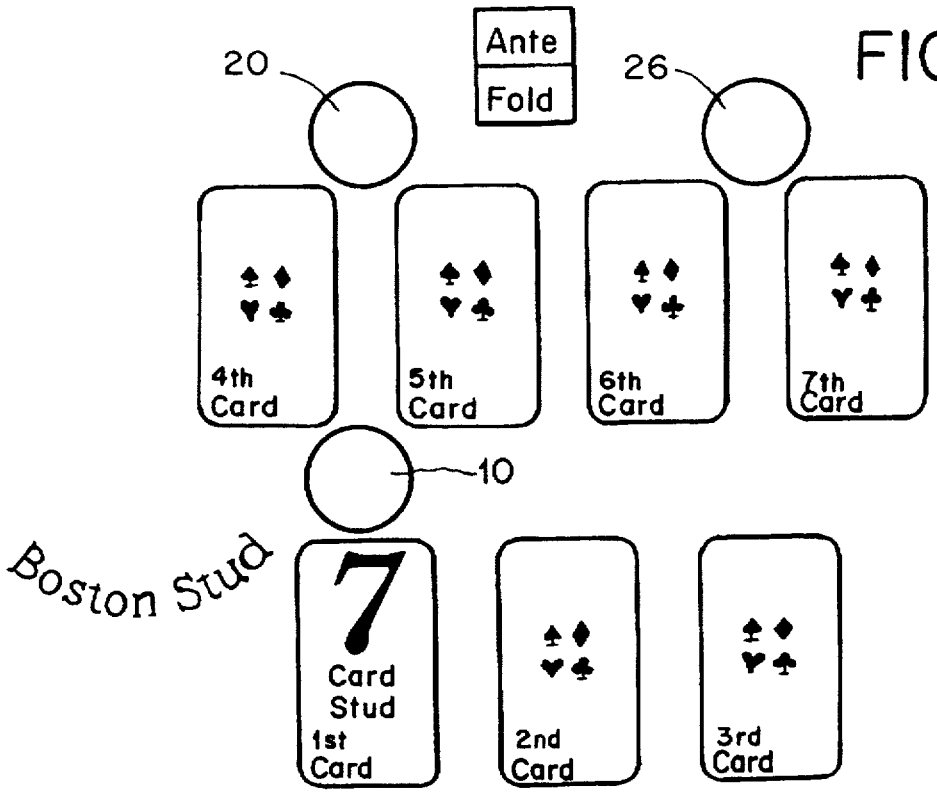
FIG. 2 illustrates a player's betting station in the embodiment illustrated in FIG. 1.

FIGS. 1 and 2 illustrate a seven-card version of one embodiment of the present invention wherein players are required to make a wager by placing that wager in a first wager area 10. In the illustrated embodiment, the initial wager is placed in a circular wager area 10 above the first card. An option that may be used with this embodiment of the present invention is to also require players to place a wager in a predetermined amount in the "ante" box 15 before play commences.

After the player has placed a first wager in initial wager area 10, the player receives three cards and the dealer is dealt seven cards face down. The player is then permitted to view his/her cards but is not permitted to reveal his/her cards to other players. After viewing his/her first three cards, the player has the option of folding or placing a second wager in wager area 20 located above the fourth and fifth card areas. If the player does not choose to make a second wager, his/her hand is folded and all previous bets are forfeited. If the player does place a wager in second wager area 20, the player receives two additional cards according to this embodiment. The player is then again given an opportunity to review his/her cards and decide whether to fold or to place an additional wager in third wager area 25. If the player fails to make the third wager in wager area 25, then the player's hand is folded and the player forfeits his/her right to receive a winning payout during that hand. If the player makes a third wager in wager area 25, the player's hand is completed with a sixth and seventh card. The player then qualifies for receiving a winning payout which is determined by comparing the player's best five cards according to officially ranked poker hands with the cards of the dealer after all hands have been dealt. The dealers cards are only revealed after all players have completed their hands or folded. According to this embodiment of the present invention, the dealer preferably uses a single deck of standard playing cards and pays winning hands in an amount equal to the amount wagered. Those skilled in the art will appreciate that it is within the scope of the present invention to use multiple decks of playing cards and may vary the odds of winning payouts as desired.

Figure 4:
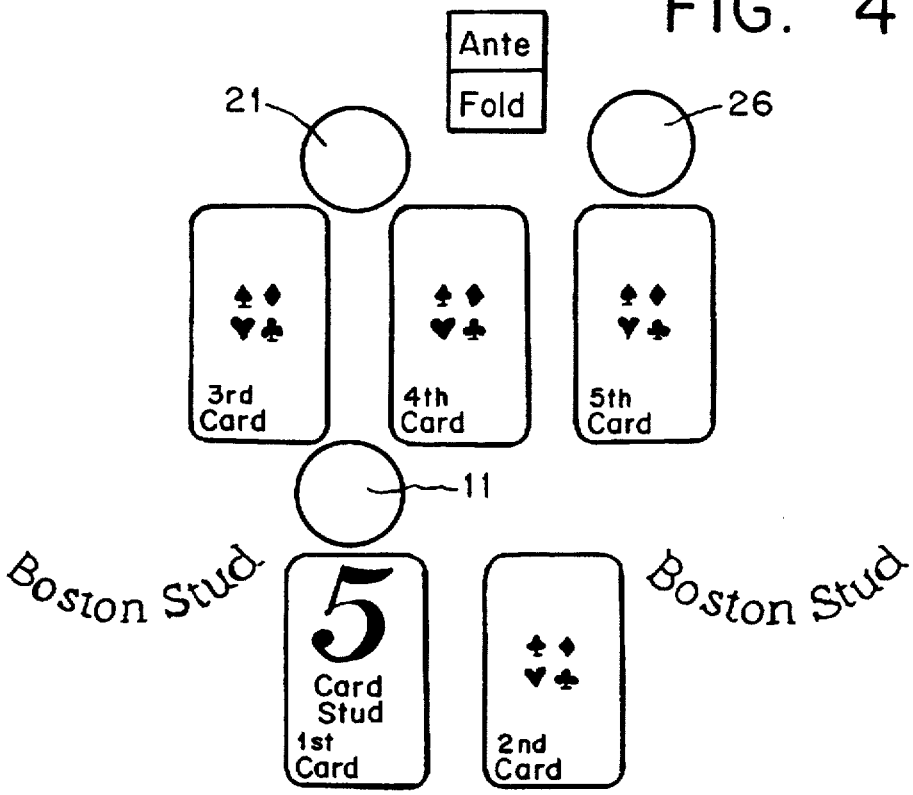
FIG. 4 illustrates a player's station of the embodiment illustrated in FIG. 3.
Figure 3:
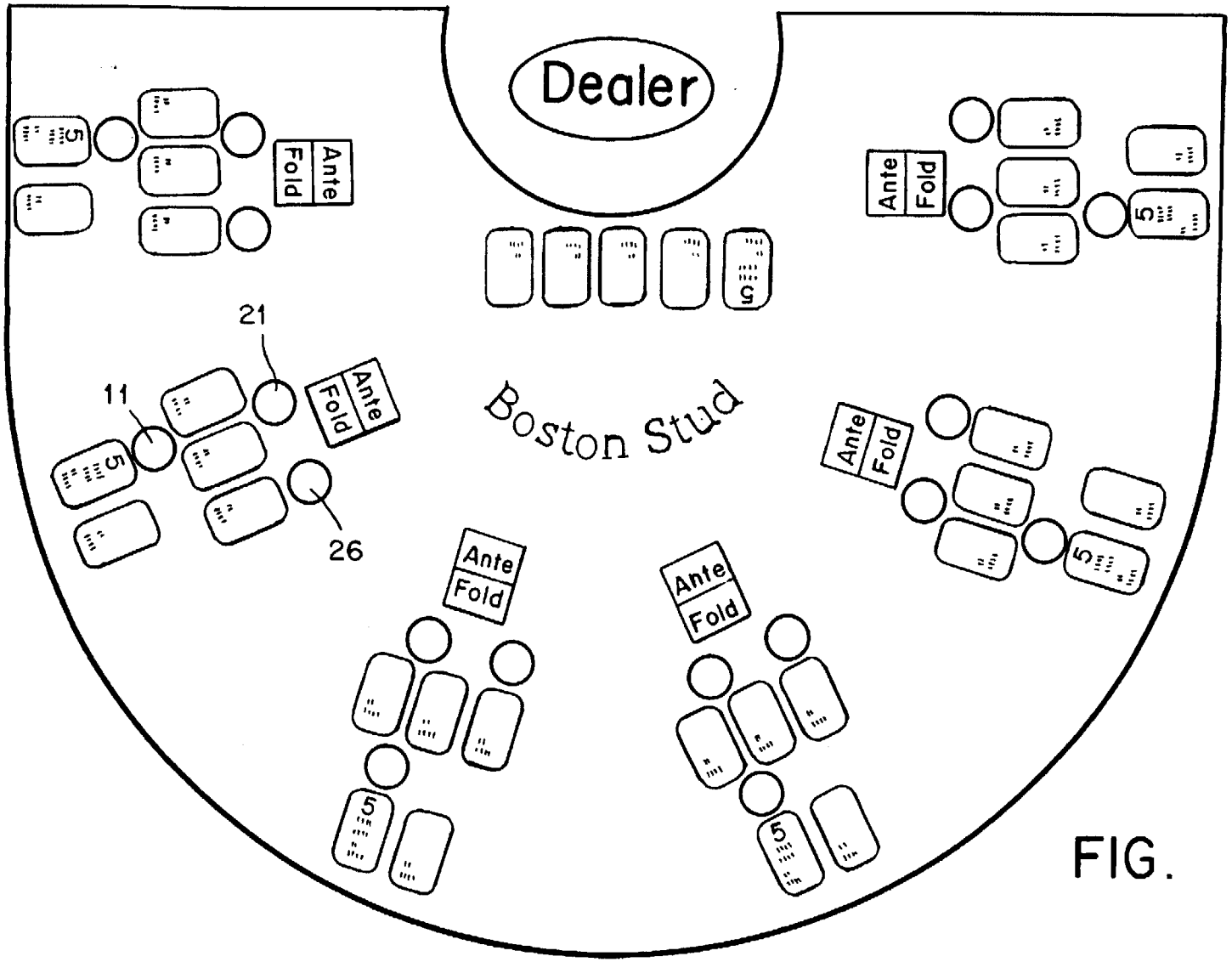
FIG. 3 is a game board layout of a five-card embodiment of the present invention.

FIGS. 3 and 4 illustrate a five-card version of this embodiment of the present invention which is played by similar rules to the embodiment described above except that upon placing a first wager in wager area 11, the player receives only two cards. Before receiving the player's third and fourth card, the player must place an additional wager in the same amount in wager area 21. Similarly, before receiving the player's fifth and final card, the player must place another wager in the same amount in wager area 26.

After all players have received their cards, the dealer reveals his/her cards and then collects losing wagers and provides winning payouts to winning players.

According to an alternative embodiment of the present invention, the amounts of the subsequent wagers are greater than the player's initial wager. For example, the subsequent wagers may increase in a progressive nature. FIGS. 5 and 6 illustrate wager amounts of this embodiment of the present invention wherein the player's second wager must be in an amount double the player's initial wager and the player's third wager must be an amount equal to triple the player's initial wager. In all other respects, this embodiment of the present invention is played by the same rules as the embodiments described above with respect to FIGS. 1 to 4. It will be appreciated that for this and all other embodiments of the present invention, the gaming establishment and/or dealer may set minimum and maximum amounts for the first wager and the subsequent wagers may simply be multiples of the first wager. In all embodiments, once the player has placed an initial wager, the value of subsequent wagers is set and cannot be changed during that hand.

Figure 7:
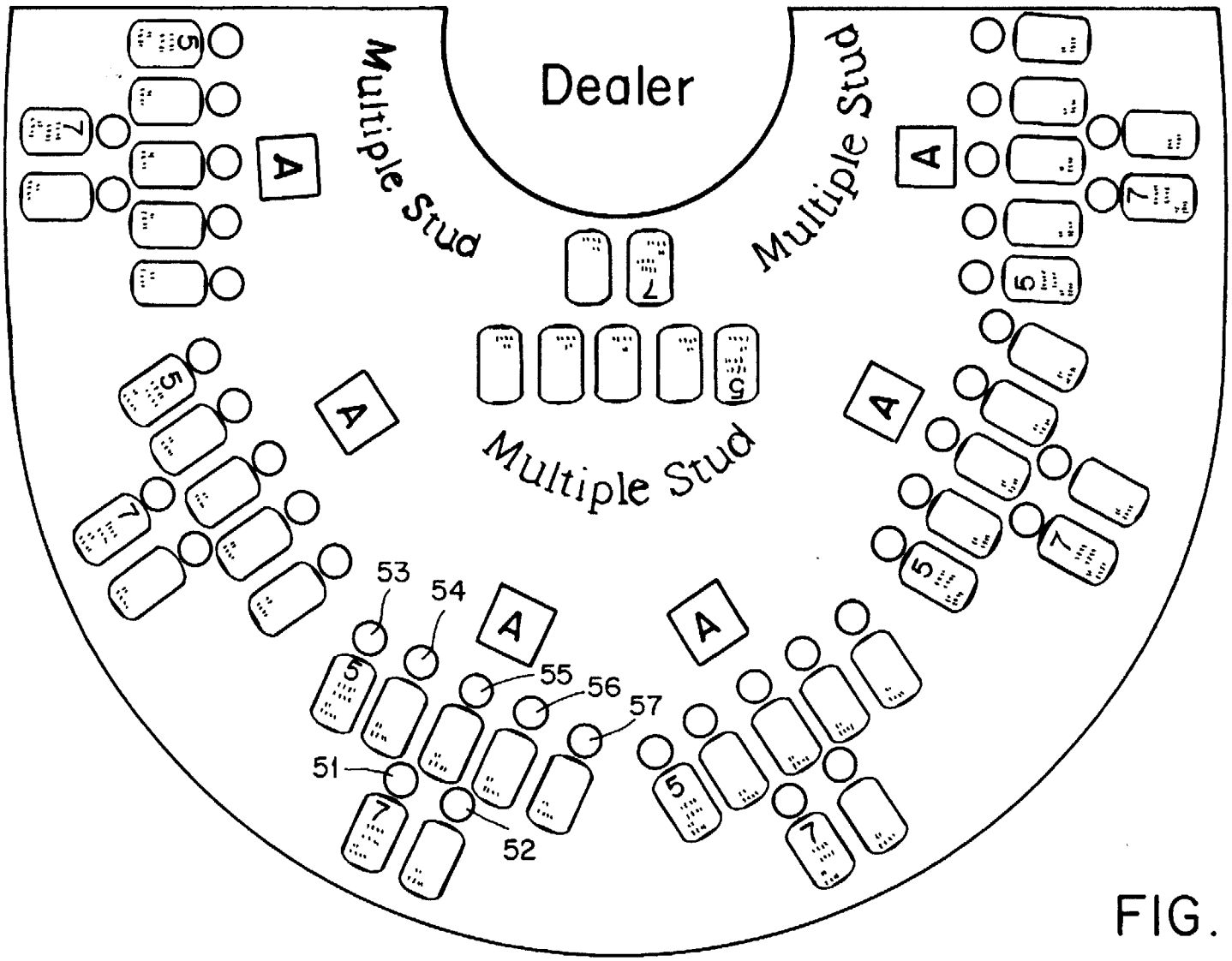
FIG. 7 is a game board layout of another alternative embodiment of the present invention.
Figure 8:
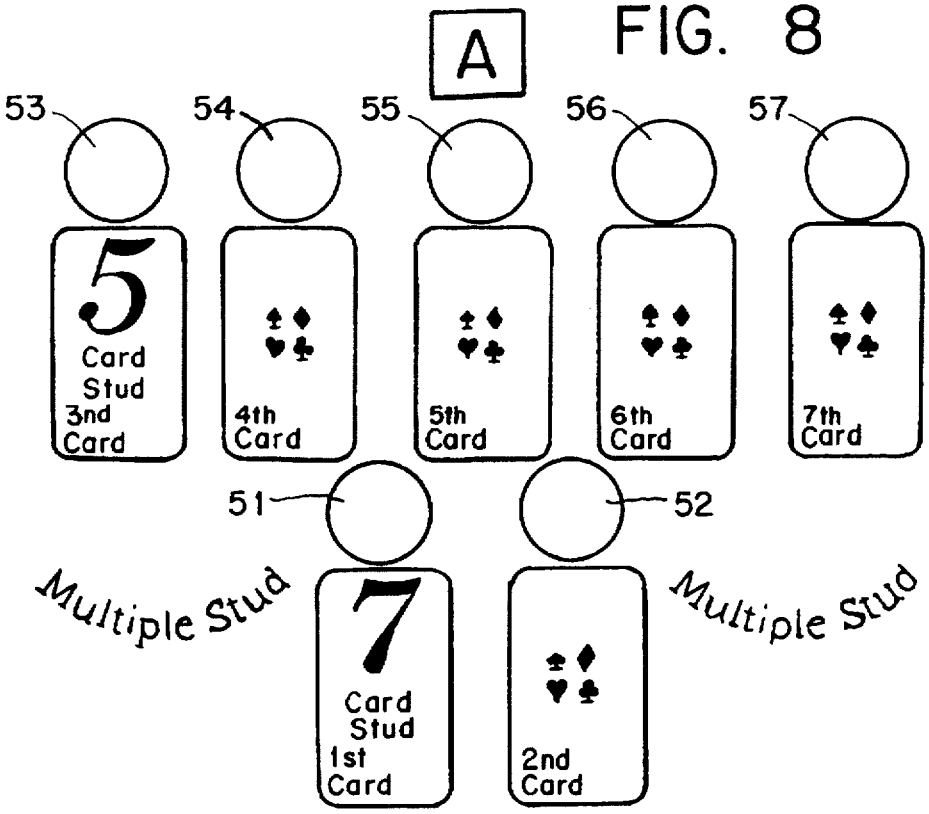
FIG. 8 illustrates a player's station of the embodiment illustrated in FIG. 7.

FIGS. 7 and 8 illustrate five-card and seven-card versions of an alternative embodiment of the present invention. According to this embodiment, after play has started a player must place a wager of a predetermined value, relative to the player's initial wager, in order to receive each subsequent card. According to the preferred table layout illustrated in FIG. 7, a single layout can be used for playing either the five-card version or the seven-card version of this game. If the player wishes to play the seven-card version, the first wager is placed in wager area 51. Players playing the seven-card version then must place wagers in each of wager areas 52 to 57 in order to remain in the hand. Alternatively, if a player desires to play the five-card version of this game, the player places his/her first wager in wager area 53 and then must place wagers in each of boxes 54 to 57 in order to remain in hand. Other indicia are advantageously provided on the game board in order to indicate where the seven-card version and five-card versions start.

Figure 10:
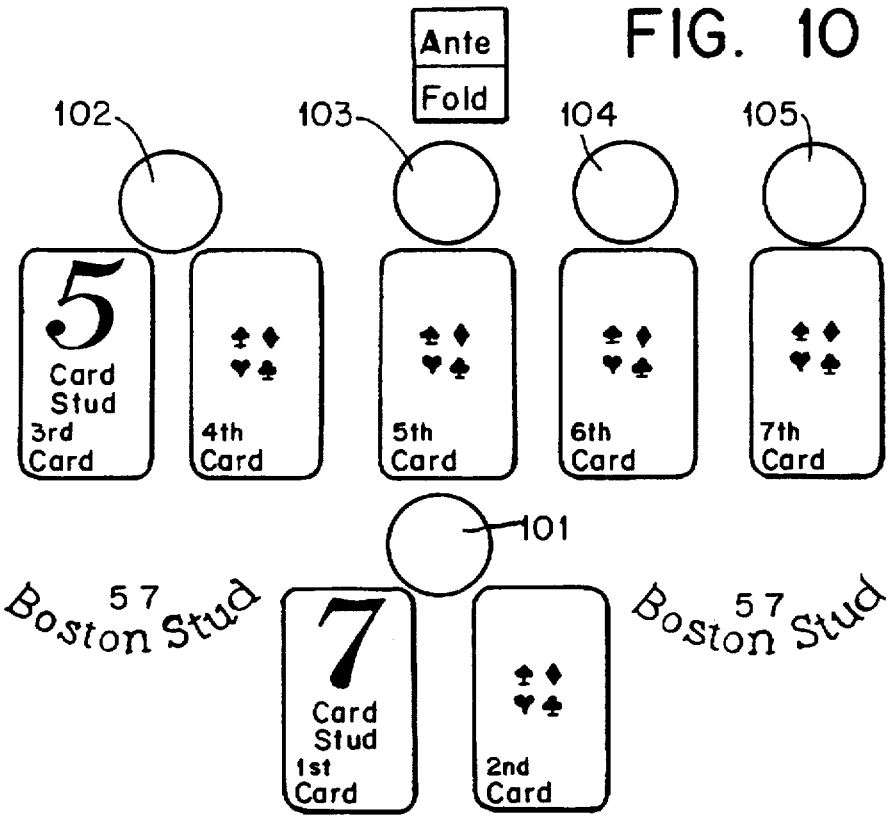
FIG. 10 illustrates a player's station of the embodiment illustrated in FIG. 9.
Figure 9:
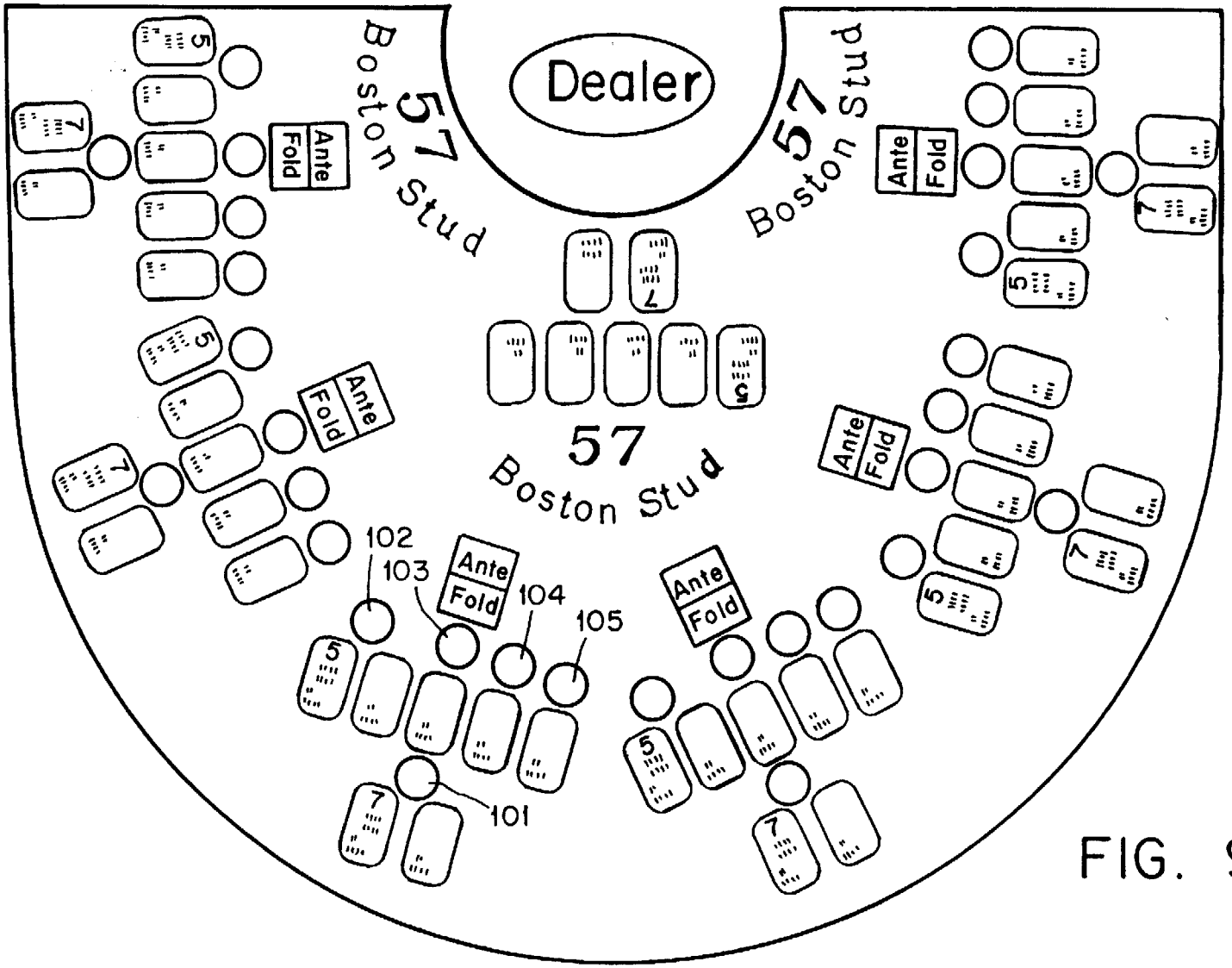
FIG. 9 illustrates a game board layout of a still further embodiment of the present invention.

A still further embodiment of the present invention is illustrated in FIGS. 9 and 10 wherein a player is required to wager on the last three cards of a hand if the player wishes to stay in the hand. This embodiment is preferably played on a game board laid out in a fashion similar to the embodiment illustrated in FIGS. 7 and 8, except that the number of wagering areas is reduced. According to this embodiment of the present invention, before play begins, each player must place a wager in wager area 101 if the player wishes to play the seven-card version of this game. After reviewing that player's first two cards, if the player wishes to continue, the player must then place an additional wager in wager area 102 in order to receive two more cards. Each of the final three cards require subsequent wagers in wager areas 103 through 105. Alternatively, if the player wishes to play the five-card version of this game, the player places an initial wager in wagering area 102 in order to receive an initial two cards. If the player wishes to continue, the player must place an additional wager in wager area 103 before receiving the third card. Similarly, before receiving the fourth card, the player must place a wager in wager area 104 and subsequently a wager in wager area 105 if the player wishes to complete the hand.

Figure 11:
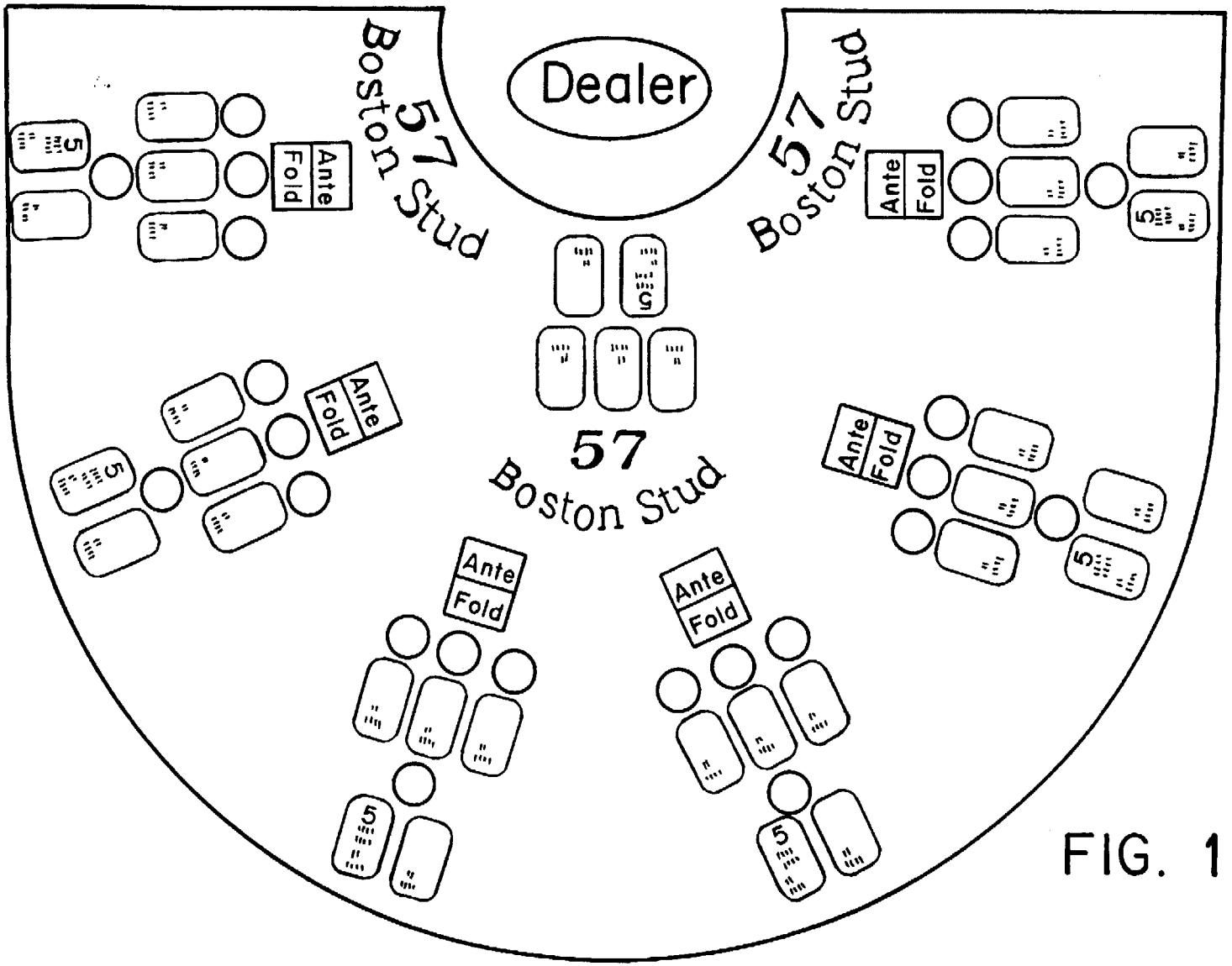
FIG. 11 is a game board layout of a still further embodiment of the present invention.
Figure 12:
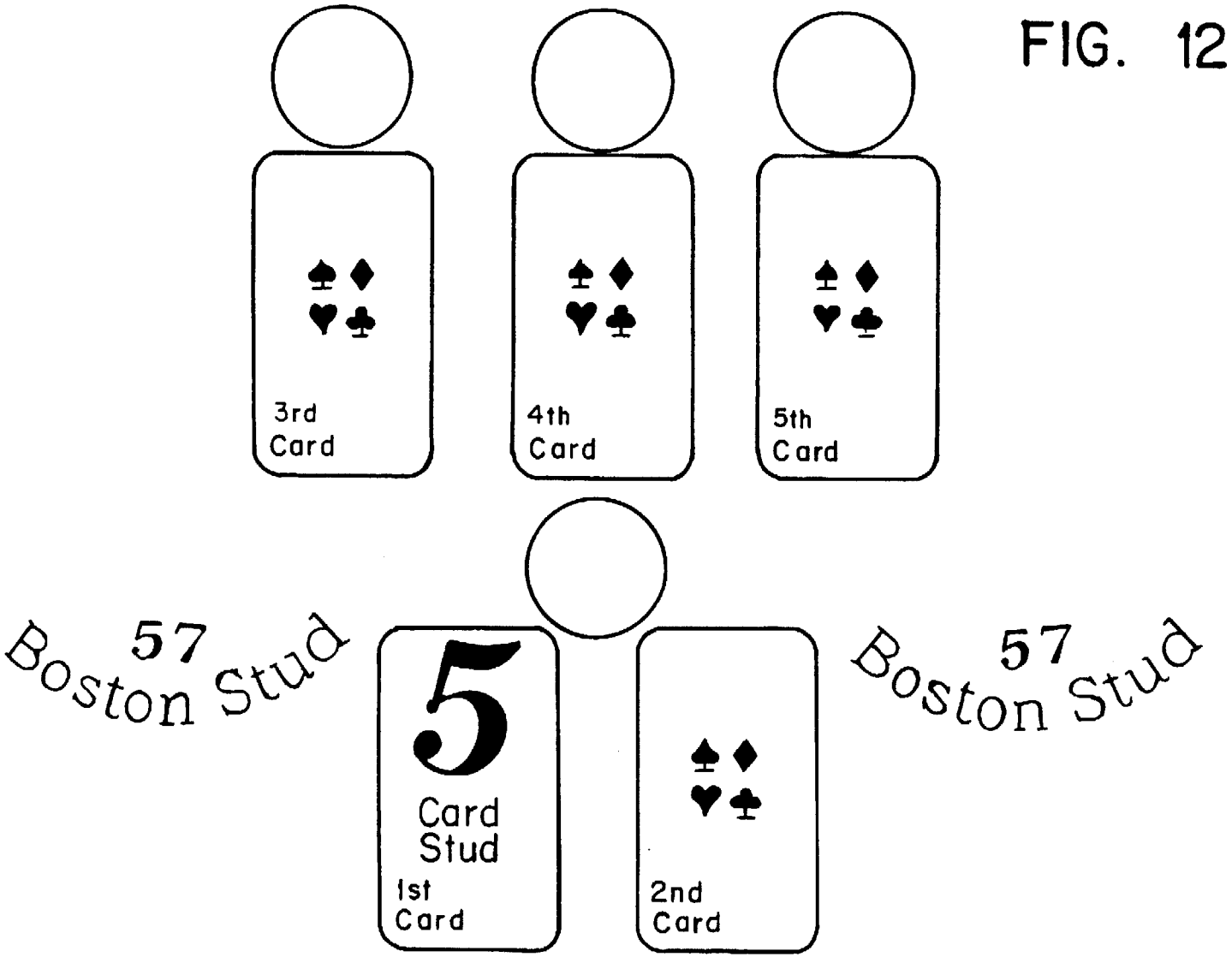
FIG. 12 illustrates a player's station of the embodiment illustrated in FIG. 11.

If the gaming establishment does not wish to provide players with the opportunity to play a seven-card version of the embodiment illustrated in FIGS. 9 and 10, a game layout of the type illustrated in FIGS. 11 and 12 can be utilized.

From the present description, it will be appreciated that the present invention provides players with numerous wagering opportunities requiring numerous decisions on the part of each player. The amounts of wagers following the initial wager are fixed relative to the initial wager and must be placed in order for the player to remain in a given hand.

The various embodiments of the present invention also provide players with the ability to play poker-type games in a casino setting against one person, i.e. the dealer, rather than playing in a group with each player playing against other players. It also allows a player to play one on one with the dealer and does not require a full complement of players in order to play the game. In addition to regular winning payouts described above, the various embodiments of the present invention include an "ANTE" wager area. The ANTE can be used for several purposes including providing the gaming establishment with a guaranteed win, serving as a source of revenue for a progressive bet or fixed jackpot, providing the gaming establishment with a payout if the deal is to rotate amongst players rather than an employee of the gaming establishment, or the gaming establishment can determine whether a winning player will retain that player's ante.

Another novel aspect of the present invention comprises methods of playing games and game structures which permit one or more players to play both five and seven-card versions of a single game during a single hand. While the preferred embodiments of the present invention utilize five and seven-card versions of stud poker, it is also within the scope of the present invention to play games using different numbers of cards.

The preferred layouts of the present invention also advantageously indicate the positions where cards are to be placed and other indicia indicate the number of cards that a player will receive upon placing a specified wager.

As mentioned above, the various embodiments of the present invention may be combined with other wagering options or bonuses. For example, a progressive wagering feature can be provided which can require additional wagers to be placed by a player in order to participate. Alternatively, players may automatically qualify for a fixed jackpot or progressive feature simply by participating in a game. According to one preferred embodiment, players are provided with an enhanced payout if their hands match the dealer's hand. It is also within the scope of the present invention to provide enhanced payouts to players receiving certain predetermined hands, for example, a royal flush.

What is claimed is:

1. A method of playing a card game comprising the steps of:

requiring at least one player to make at least one initial wager;

providing a dealer with a plurality of cards face down;

providing said player with at least one card to form an initial partial hand;

subsequently requiring said player to place a second wager in an amount related to said initial wager by a predetermined multiple but unrelated to the amounts of the wagers of other players in order to continue playing said hand;

providing said player with at least one additional card if said player increased said player's initial wager by said predetermined amount; and wherein different players are not required to wager the same amounts comparing said dealer's hand with said player's hand according to a poker ranking and determining winning payouts based upon said comparison.

2. A method of playing a card game according to claim 1 wherein said player is required to make a third wager in order to continue playing said hand.

3. A method of playing a card game according to claim 1 wherein said player is required to make a wager before receiving each card subsequent to said player's receipt of said initial partial hand.

4. A method of playing a card game according to claim 1 wherein said player is required to make a wager prior to receipt of each of three last cards provided to said player, in order to continue playing said hand.

5. A method of playing a card game according to claim 1 wherein a plurality of players act as dealers on a rotating basis.

6. A method of playing a card game according to claim 1 wherein only one player is required to play said game.

7. A method of playing a card game according to claim 1 wherein said player is also required to make an ante wager before receiving said initial partial hand.

8. A method of playing a card game according to claim 1 further comprising the step of providing a game board comprising indicia of the number of cards that a player may elect to receive.

9. A method of playing a card game according to claim 1 further comprising the step of providing a game board comprising indicia of the number of wagers that a player must place in order to remain in a hand.

10. A method of playing a card game according to claim 9 further comprising indicia of the number of additional cards that a player can receive by placing an additional wager.

11. A method of playing a card game according to claim 1 further comprising the steps of providing a game board comprising indicia of where a player should place an initial wager for a hand having the desired number of cards.

12. A method of playing a card game according to claim 1 wherein a player is required to place wagers of successively greater amounts in order to remain in a hand.

13. A method of playing a card game according to claim 1 wherein further comprising the step of providing a player with the chance to win an enhanced payout.

14. A method of playing a card game according to claim 13 wherein said enhanced payout increases progressively before a player wins said enhanced payout.

15. A method of playing a card game according to claim 13 wherein a player's hand must be one of a preselected hand for said player to win said enhanced payout.

16. A method of playing a card game comprising the steps of:

requiring a first player to make at least one initial wager and requiring a second player to make at least one initial wager;

providing a dealer with a plurality of cards face down;

providing said first player with at least one card to form an initial partial hand;

subsequently requiring said first player to place a second wager in an amount related to said first player's initial wager by a predetermined multiple in order to continue playing said hand;

providing said first player with at least one additional card if said first player increased said first player's initial wager by said predetermined amount;

providing said second player with at least one card to form an initial partial hand;

subsequently requiring said second player to place a second wager in an amount related to said second player's initial wager by a predetermined multiple in order to continue playing said hand;

providing said second player with at least one additional card if said second player increased said second player's initial wager by said predetermined amount;

wherein said first hand and said second hand have different numbers of cards; and comparing said dealer's hand with said players' hands according to a poker ranking and determining winning payouts based upon said comparison.

17. A method of playing a card game according to claim 11 wherein one of said hands requires five cards to form a complete hand and a second hand requires seven cards to form a complete hand.

18. A method of playing a card game comprising the steps of:

starting a hand by requiring a player to make at least one initial wager;

providing a dealer with a plurality of cards face down;

providing said player with at least one card to form an initial partial hand;

subsequently requiring said player to place a second wager in an amount related to said initial wager by a predetermined multiple in order to continue playing said hand;

providing said player with at least one additional card if said player increased said player's wager by said predetermined amount;

further comprising the step of providing a player with a chance to win an enhanced payout and wherein a player's hand must match the dealer's hand for a player to win said enhanced payout; and comparing said dealer's hand with said player's hand according to a poker ranking and determining winning payouts based upon said comparison.

19. A method of playing a card game comprising the steps of:

starting a hand by requiring a player to make at least one initial wager;

providing a dealer with a plurality of cards face down;

providing said player with at least one card to form an initial partial hand;

subsequently requiring said player to place a second wager in an amount related to said initial wager by a predetermined multiple in order to continue playing said hand;

providing said player with at least one additional card if said player increased said player's wager by said predetermined amount;

providing a player with a chance to win an enhanced payout wherein the amount of said enhanced payout will be different for different numbers of cards in said player's complete hand; and comparing said dealer's hand with said player's hand according to a poker ranking and determining winning payouts based upon said comparison.

20. A method of playing a poker-type card game comprising a dealer comprising the steps of:

providing a plurality of players with the option of placing initial wagers and indicating which one of a plurality of poker games each of said players desire to play wherein different poker games require different numbers of cards in order to complete a hand;

said dealer providing cards to a plurality of players and to said dealer, each player and the dealer receiving only one hand of cards, wherein a first player receives a first predetermined number of cards to complete a first poker hand and a second player receives a second predetermined number of cards, wherein the number of cards in said second hand is different from the number of cards in said first hand, to complete a second poker hand.

21. A method of playing a card game according to claim 20 wherein said first predetermined number is five.

22. A method of playing a card game according to claim 20 wherein said second predetermined number is seven.

23. A method of playing a card game according to claim 20 wherein each player is required to make at least one wager subsequent to an initial wager in order to complete said player's hands.

* * * * *